US012352542B2

(12) United States Patent
Synnestvedt et al.

(10) Patent No.: US 12,352,542 B2
(45) Date of Patent: Jul. 8, 2025

(54) INSERTS HAVING BALLISTIC PROTECTION LAYER

(71) Applicant: ZEPHYROS, INC., Romeo, MI (US)

(72) Inventors: Blake Synnestvedt, Romeo, MI (US); Jason Walker, Romeo, MI (US)

(73) Assignee: ZEPHYROS, INC., Romeo, MI (US)

( * ) Notice: Subject to any disclaimer, the term of this patent is extended or adjusted under 35 U.S.C. 154(b) by 155 days.

(21) Appl. No.: 17/800,442

(22) PCT Filed: Feb. 17, 2021

(86) PCT No.: PCT/US2021/018300
§ 371 (c)(1),
(2) Date: Aug. 17, 2022

(87) PCT Pub. No.: WO2021/167933
PCT Pub. Date: Aug. 26, 2021

(65) Prior Publication Data

US 2023/0077548 A1 Mar. 16, 2023

Related U.S. Application Data

(60) Provisional application No. 62/978,879, filed on Feb. 20, 2020.

(51) Int. Cl.

| | |
|---|---|
| ***F41H 7/04*** | (2006.01) |
| ***F41H 5/013*** | (2006.01) |
| ***F41H 5/04*** | (2006.01) |

(52) U.S. Cl.
CPC ..... *F41H 7/04* (2013.01); *F41H 5/013* (2013.01); *F41H 5/0485* (2013.01)

(58) Field of Classification Search
CPC ..... F41H 7/04; F41H 5/013; F41H 5/0485; F41H 5/0471
See application file for complete search history.

(56) References Cited

U.S. PATENT DOCUMENTS

| | | | | |
|---|---|---|---|---|
| 3,431,818 A | | 3/1969 | King | |
| 4,739,690 A | * | 4/1988 | Moskowitz | F41H 5/0414 428/909 |
| 5,531,500 A | * | 7/1996 | Podvin | F41H 5/226 49/501 |
| 6,372,334 B1 | | 4/2002 | Wycech | |
| 7,597,382 B2 | | 10/2009 | Vilcek et al. | |

(Continued)

FOREIGN PATENT DOCUMENTS

| | | | | |
|---|---|---|---|---|
| CN | 109648925 A | * | 4/2019 | B32B 15/08 |
| EP | 1089870 B1 | | 2/2004 | |

(Continued)

OTHER PUBLICATIONS

India First Exam Report dated Apr. 25, 2023, Application No. 202237047034.

(Continued)

*Primary Examiner* — Lori Lyjak
(74) *Attorney, Agent, or Firm* — The Dobrusin Law Firm, P.C.

(57) ABSTRACT

An insert for structurally reinforcing a cavity of a structural member, wherein the insert includes a ballistic material to prevent penetration of the structural member by flying debris, fragmentation, or both.

15 Claims, 3 Drawing Sheets

(56) References Cited

U.S. PATENT DOCUMENTS

| | | | | |
|---|---|---|---|---|
| 7,997,181 | B1 * | 8/2011 | Tunis | F41H 5/0492 89/917 |
| 8,043,982 | B2 | 10/2011 | Telander | |
| 9,140,524 | B2 * | 9/2015 | Fingerhut | F41H 5/0435 |
| 9,291,433 | B2 * | 3/2016 | Compton | F41H 5/0478 |
| 9,464,872 | B2 * | 10/2016 | Dyke | F41H 5/0478 |
| 9,869,535 | B2 * | 1/2018 | Johnston | F41H 5/0492 |
| 10,414,921 | B1 * | 9/2019 | Dehni | C08G 18/7664 |
| 10,429,152 | B2 * | 10/2019 | Glover | E06B 5/10 |
| 2004/0020354 | A1 | 2/2004 | Ravid et al. | |
| 2009/0241764 | A1 | 10/2009 | Cohen | |
| 2009/0320676 | A1 * | 12/2009 | Cronin | F41H 5/0421 89/36.02 |
| 2010/0012004 | A1 | 1/2010 | Telander | |
| 2011/0041675 | A1 * | 2/2011 | Ermalovich | F41H 5/0457 89/36.02 |
| 2011/0290105 | A1 | 12/2011 | Greenwood | |
| 2012/0325076 | A1 * | 12/2012 | Monette, Jr. | B32B 37/02 89/917 |
| 2013/0312593 | A1 * | 11/2013 | Carberry | F41H 5/0414 89/36.02 |
| 2015/0059042 | A1 | 3/2015 | Aquino | |
| 2019/0041168 | A1 | 2/2019 | Gamache et al. | |
| 2019/0353464 | A1 | 11/2019 | Nardone | |
| 2020/0001931 | A1 * | 1/2020 | Connor | B32B 27/12 |
| 2021/0025672 | A1 * | 1/2021 | Shearer | F41C 33/041 |
| 2023/0101875 | A1 * | 3/2023 | Synnestvedt | B32B 13/02 89/36.02 |

FOREIGN PATENT DOCUMENTS

| | | | | |
|---|---|---|---|---|
| EP | 1361408 | B1 | 7/2006 | |
| WO | 2009/032585 | A1 | 3/2009 | |
| WO | WO-2015179013 | A2 * | 11/2015 | F41H 1/00 |
| WO | 2016/025787 | A1 | 2/2016 | |
| WO | 2017/205172 | A1 | 11/2017 | |
| WO | 2019/241295 | A1 | 12/2019 | |
| WO | 2020/206346 | A1 | 10/2020 | |
| WO | 2021/173709 | A1 | 9/2021 | |

OTHER PUBLICATIONS

International Search Report and Written Opinion, Application No. PCT/US2021/018300, mailed Aug. 2, 2021.

* cited by examiner

INSERTS HAVING BALLISTIC PROTECTION LAYER

FIELD

The present teachings generally relate to structural reinforcing inserts, and more specifically, to reinforcing inserts containing a ballistic material.

BACKGROUND OF THE INVENTION

Transportation vehicles frequently utilize structural members to form, support, reinforce, or a combination thereof certain vehicle structures. These structural members are often integrally formed with a body of the vehicle. Often, structural members are interconnected to form the overall body structure of the vehicle. For example, a structural member may form each of an A-pillar, B-pillar, C-pillar, and liftgate of a vehicle body, and all the structural members may be interconnected to form the body of the vehicle.

In certain circumstances, it may be desirable for the vehicle frame to be further reinforced to protect a passenger within the vehicle. For example, vehicles may frequently be retrofit with additional paneling to deflect projectiles or debris from penetrating the frame of the vehicle and entering a cabin of the vehicle, thereby potentially harming the passenger. Extensive labor, additional parts, and complicated processes may frequently be required to create such an armored vehicle. In addition to requiring excess costs to create an armored vehicle, often one or more portions of the vehicle are unable to be further reinforced. For example, many of the intricate or not easily accessible components of the vehicle frame such as the liftgate, pillars, joints, or a combination thereof may not be reinforced. As a result, even after extensive retrofitting, the armored vehicle may still include a plurality of weak points that will not fully protect a passenger.

Attempts have been made to further reinforce the aforementioned weak points of the vehicle during the manufacturing and assembly process. One such attempt is by positioning an insert within the structural member to improve structural integrity, dampen vibrations, attenuate sound, or a combination thereof of the structural member. However, these reinforced structural members are unable to provide sufficient protection for an armored vehicle to prevent debris or fragmentation from entering the vehicle cabin caused by a bullet or artillery-shell. Additionally, it may be still further desirable to improve the structural members with an improved insert that better augments the structural members during a crash.

Thus, there remains a need for an insert for a structural member that meets the demands of an armored vehicle. What is needed is an insert having a ballistic material. There remains a need for an insert that further improves the strength of structural members. What is needed is an insert having a ballistic material that further stiffens the insert and thus the structural member. There also remains a need for a method of manufacturing an armored vehicle that decreases secondary operations. What is needed is a reinforced vehicle that may be manufactured during original assembly and not require retrofitting. Additionally, there remains a need to further reinforce a vehicle. What is needed is an insert that provides ballistic reinforcement of components of the vehicle that are conventionally inaccessible for reinforcement.

SUMMARY

The present teachings meet one or more of the present needs by providing an insert for structurally reinforcing a cavity of a structural member, wherein the insert includes a ballistic material to prevent penetration of the structural member by flying debris, fragmentation, or both.

The present teachings meet one or more of the present needs by providing an insert, wherein: the insert includes a core at least partially encapsulated by a shell; the shell fully encapsulates the core and the shell is made of the ballistic material; the shell fully encapsulates the core and the core is made of the ballistic material; wherein the ballistic material is disposed along an outer surface of the insert as a coating; the insert includes a multilayered structure and the multilayered structure includes a ballistic layer and a reinforcing layer; the ballistic layer is sandwiched between a pair of reinforcing layers; the reinforcing layer is made from thermoplastic elastomeric rubber (TPER); the insert is made of thermoplastic elastomer rubber (TPER); the ballistic material is Kevlar® fibers, aramid fibers, or both; the ballistic material is a fiber material mixed within a composition of the insert to form a substantially uniform insert structure; the insert is secured within the cavity by an adhesive; wherein the adhesive is disposed along one or more outer surfaces of the insert; the adhesive is an expandable material; the insert is a foamable and/or expandable material; the insert includes one or more fasteners to secure the insert within the cavity; the one or more fasteners are overmolded onto the insert; the insert is a panel having a contour that mates to an interior surface of the cavity; the panel is preformed so that the contour of the panel substantially follows the interior surface of the structural member; the ballistic layer and the reinforcing layers are thermoformed; or a combination thereof.

The present teachings meet one or more of the present needs by providing: a structural member that meets the demands of an armored vehicle; an insert having a ballistic material; an insert that further improves the strength of structural members; an insert having a ballistic material that further stiffens the insert and thus the structural member; a method of manufacturing an armored vehicle that decreases secondary operations; a reinforced vehicle that may be manufactured during original assembly and not require retrofitting; an insert that provides ballistic reinforcement of components of the vehicle that are conventionally inaccessible for reinforcement; or a combination thereof.

DETAILED DESCRIPTION

Figure 1:
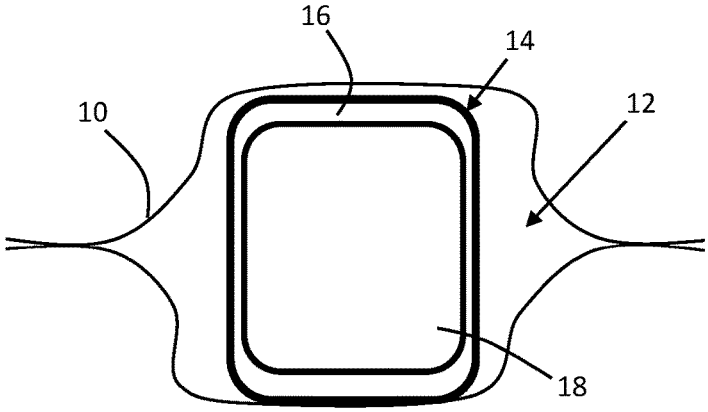
FIG. 1 is a cross-sectional view of an insert positioned within a structural member.

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings generally relate to an insert. The insert may function to provide structural integrity to a vehicle. The insert may function to support one or more vehicle structures, vehicle components, or both. The insert may be configured for integration into any vehicle, such as an automobile, truck, airplane, boat, train, or a combination thereof. While the automotive industry is discussed in detail herein, it is envisioned that the insert may be configured for any industry requiring structural reinforcement, such as aeronautical, aerospace, residential and/or commercial real estate construction, transportation, or a combination thereof. The insert may reinforce one or more structural members of a vehicle.

The insert may provide increased structural integrity to components of a vehicle. It is contemplated that the insert may increase structural integrity of components that are conventionally inaccessible for reinforcement during and/or after assembly of the vehicle. Such components may include, but are not limited to, pillars of the vehicle body (A-pillar, B-pillar, C-pillar, etc.), joints along the vehicle body, vehicle structure forming a liftgate, any other components that do not allow for manual or mechanical access, or a combination thereof. The insert may increase structural integrity during an impact of the vehicle. The insert may increase energy absorption from a direct impact, an indirect impact, or both. The insert may increase stiffness, hardness, or both of a structural member of a vehicle. For example, the insert may utilize a first material to increase impact absorption and a second material to increase stiffness.

It is envisioned that insert may prevent debris or fragmentation from entering a vehicle cabin. The insert may prevent the debris or fragmentation from penetrating a structural member. The debris or fragmentation may be a result of a bullet, artillery-shell, or both. As such, the insert may be utilized in the manufacturing of armored vehicles. For example, the insert may be inserted into structural members that would not conventionally be reinforced, such as one or more pillars, the liftgate, or both. The insert may meet the demands of the armored vehicle industry to protect a passenger within the vehicle cabin.

To facilitate such demanding performance, the insert may include a ballistic material. The ballistic material may be any material that prevents the debris or fragmentation from penetrating the vehicle into the passenger cabin and potentially harming a passenger. The ballistic material may be incorporated into the insert in a variety of ways. The insert may include the ballistic material within a composition of the insert. For example, the insert may be made of a thermoplastic or thermosetting material and the thermoplastic or thermosetting material includes a ballistic material integrated therein. As such, it is envisioned that the ballistic material may be provided in the form of pellets, chunks, powder, or a combination thereof. However, it is contemplated that the ballistic material may be in the form of fibers incorporated into a composition of the insert. The fibers may be arranged in any desired orientation. The fibers may be linear, nonlinear, or both. The fibers may be uniform in thickness, length, or both. The fibers may also be nonuniform in thickness, length, or both.

The ballistic material may be any material that may combine with a composition of the insert. The ballistic material may be any material that prevents penetration of debris or fragmentation. The ballistic material may be para-aramids or aromatic polyamides such as Kevlar® or Twaron®. The ballistic material may be a high-molecular weight polyethylene (HMWPE), ultra-high-molecular weight polyethylene (UHMWPE), or both. The ballistic material may be a fiber material such as aramid fibers. The ballistic material may be moldable. The ballistic material may be present in a foamable or expandable material. The ballistic material may be used in conjunction with a reinforcing material of the insert.

The reinforcing material of the insert may be a thermosetting material. For example, the reinforcing material of the insert may a thermoplastic elastomeric rubber (TPER), a thermoplastic vulcanizate (TPV), other thermoplastic elastomers (TPE), or a combination thereof. The reinforcing material may be expandable, foamable, or both. The reinforcing material may be thermoplastic. The reinforcing material may include one or more fiber materials. The reinforcing material may include one or more fillers, metal particles, secondary additives, foaming agents, curing agents, processing aids, lubricants, or a combination thereof.

The ballistic material may be disposed within the reinforcing material to form the insert. The ballistic material may be mixed with the reinforcing material prior to processing to form a substantially homogeneous resultant composition. For example, the ballistic material may be aramid fibers disposed within a TPER reinforcing material to form a substantially homogeneous insert. It may be desired that the resultant insert, regardless of manufacturing process, may withstand conventional manufacturing conditions of a vehicle. Particularly, it is envisioned that the ballistic material and the reinforcing material (and the resultant insert) may withstand heightened temperatures upwards of greater than about 400° C., e-coating of the vehicle, or both.

While the ballistic material may be homogeneously or monolithically integrated into a composition of the insert, it is also envisioned that the ballistic material may be integrated into the insert in other manners. For example, the insert may include a core/shell structure. The core may be at least partially encapsulated within the shell. The core may be fully encapsulated within the shell. The shell may include an open channel that exposes the core. The shell may act as a protective layer to the core. For example, the core may be a reinforcing material while the shell is a ballistic material that encapsulates the core. As such, it is envisioned that the ballistic material may prevent penetration of debris or fragmentation into the core. The core and shell may have any desired dimensions. For example, the shell may have any desired thickness that may sufficiently encapsulate the core. The shell may have a thickness of about 1 mm or more, about 5 mm or more, or about 20 mm or more. The shell may have a thickness of about 50 mm or less, about 30 mm or less, or about 25 mm or less. The core, shell, or both may be or may include a ballistic material. For example, the shell may be a ballistic material while the core is a non-ballistic reinforcing material, or vice versa. Additionally, the core and shell may provide unique structural properties to the insert. For example, the shell may be a structurally rigid ballistic layer while the core is a compressible material such that the insert has a desired balance between rigidity and compressibility.

The core and shell structure of the insert may be manufactured in several ways. The core and shell may be coextruded or co-pultruded. The core and shell may be molded. The molding may be an injection-molding. The core or the shell may be molded separately. For example, the core may be molded, and the shell may be overmolded around the core. Alternatively, the shell may be molded, extruded, pultruded, or a combination thereof and the core may be injected into a cavity within the shell. As such, it may be gleaned from the present teachings that the core and shell may have any desired structure and tunability. Thus, the core may be positioned anywhere relative to the shell. For example, the core and the shell may be coaxial, the core may be off-centered, or both.

The insert may also be a multi-layered structure. The multi-layered structure may comprise one or more ballistic layers, one or more reinforcing layers, or both. The ballistic layers may include a ballistic material while the reinforcing layers may include a non-ballistic material. However, it should be noted that the reinforcing layers may also include a ballistic material in a lower concentration compared to a concentration within the ballistic layers. The multi-layered structure may take any desired form. For example, a ballistic layer may be sandwiched between reinforcing layers. The ballistic layers and the reinforcing layers may alternate in a stacking manner. The ballistic layers and the reinforcing layers may alternate in a radial manner throughout the insert. The ballistic layers and the reinforcing layers may be coextensive. It is envisioned that any number of layers in any combination may be utilized based on a desired application to meet demands.

The layers of the multi-layered structure may be joined. The layers may be adhered to one another, mechanically fastened to one another, chemically joined to one another, or a combination thereof. The layers may be thermoformed to create the multi-layered structure. Joining of the layers may be caused by a catalyst, such as a reactive agent, a heightened activating temperature, or a combination thereof.

The ballistic layers may exhibit similar or dissimilar properties compared to the properties of the reinforcing layers. The ballistic layers may be structurally rigid or may be flexible. The ballistic layers may prevent piercing of the insert. The ballistic layers may be pliable. The ballistic layers may be compressible. The ballistic layers may be expandable.

The reinforcing layers may exhibit similar or dissimilar properties comparted to the properties of the ballistic layers. The reinforcing layers may be structurally rigid or may be flexible. The reinforcing layers may prevent piercing of the insert. The reinforcing layers may be pliable. The reinforcing layers may be compressible. The reinforcing layers may be expandable.

The insert may also include a coating. The coating may function to further improve performance of the insert. The coating may be a ballistic material. The coating may be another material. The coating may be corrosion resistant, moisture resistant, antimicrobial, antibacterial, or a combination thereof. The coating may fully cover or partially cover an exterior surface of the insert. The coating may be applied in a localized manner to protect only desired "hot spots". The coating may be any desired thickness. The coating may be uniform across the insert or may include localized increases in thickness, undulation, varied contours, or a combination thereof. The coating may be sprayed directly onto the insert. The coating may be a laminate. The coating may be thermoformed to the insert. The coating may be overmolded at least partially along the insert.

The insert may also be in the form of a panel. The panel may follow a contour of the structural member. The panel may be a consolidated panel of TPER, TPV, TPE, or a combination thereof. The panel may be pre-shaped to substantially match a shape of the structural member. The panel may be compressed. The panel may be multi-layered. The panel may be contoured. The panel may be secured to the structural member. The panel may be inserted into a cavity of the structural member yet only fill a portion of the space of the cavity. For example, the panel may only fill about 5% or more, about 10% or more, or about 20% or more of the cavity space. The panel may fill about 40% or less, about 30% or less, or about 25% or less of the cavity space. A plurality of panels or a single panel may be utilized in a structural member. A plurality of panels may be interconnected to form a unitary structural insert. For example, the plurality of panels may form a clamshell-like structure that follows a clamshell-like structure of the structural member.

It is envisioned that the insert may be configured to reinforce a structural member. The structural member may be any member of a vehicle structure. The structural member may be hollow or may be solid. However, it is contemplated that the insert may be configured for insertion within a hollow structural member. The structural member may have any shape. The structural member may be substantially linear or nonlinear. The structural member may include one or more arcuate portions, one or more bends, one or more edges, one or more lips, one or more channels, one or more holes, one or more notches, one or more cutouts, or a combination thereof. As such, the insert may at least partially follow a contour of one or more surfaces of the structural member. For example, the insert may at least partially follow a contour or an inner surface of a cavity of a hollow structural member.

The insert may be secured to the structural member. The insert may be secured to an exterior surface of an interior surface of the structural member. For example, the insert may be positioned within a cavity of the structural member and secured to an inner surface of the structural member. The insert may be secured using mechanical fasteners integrated with the insert or may utilize secondary fasteners secured to the insert. The fasteners may be a bolt, screw, pin, hook, tab, finger, key, or a combination thereof.

The insert may be secured to the structural member using one or more adhesives. The adhesives may be disposed on one or more surfaces of the insert. The adhesives may be pressure sensitive, heat activated, expandable, or a combination thereof. For example, the adhesives may secure an initial position of the insert within a cavity of a structural member, and the adhesives may expand to fill a gap within the cavity formed between the structural member and the insert. The adhesives may permanently adhere the insert to the structural member or may act as a temporary securing means.

The insert may also be free of adhesives, fasteners, or both to secure the insert to the structural member. For example, the insert may form a friction-fit condition with a cavity of the structural member. The friction-fit condition may be established by compressing the insert and/or expanding an opening of the structural member to engage the insert and the structural member.

Turning now to the figures, FIG. 1 illustrates a cross-sectional view of an insert 14. The insert 14 is positioned within a cavity 12 of a structural member 10. The insert 14 may be configured to reinforce the structural member 10, dampen vibrations of the structural member 10, provide sound attenuation within the structural member 10, or a combination thereof. It is envisioned that the insert 14 may be configured to reinforce a structural member 10 that is difficult to otherwise support. For example, the insert 14 taught herein may be utilized in the automotive industry as an inner member within one or more pillars of a vehicle body (e.g., A-pillar, B-pillar, C-pillar, etc.), within a liftgate area of a vehicle, or both. As illustrated, the insert 14 may include a core 18 at least partially surrounded by a shell 16. The shell 16 may provide additional material properties to the insert 14 that may otherwise not be present or as prevalent in the core 18 alone. The shell 16 may include a ballistic material to encapsulate the core 18 of the insert 14. The ballistic material of the shell 16 may protect an inner cabin of a vehicle by preventing penetration of debris and/or fragmentation through the structural member 10. For example, the shell 16 may substantially prevent a bullet or artillery-shell from penetrating the structural member 10 and potentially injuring a passenger within a vehicle.

The shell 16 may be any desired thickness to encapsulate the core 18. The shell 16 may fully encapsulate the core 18 or may only partially encapsulate the core 18. For example, the shell 16 may form a C-shaped casing around the core 18 so that a channel is formed between ends of the shell 16 that exposes the core 18. As illustrated, the insert 14 may be positioned to fit substantially snugly within the cavity 12 of the structural member 10. The insert 14 may be secured to one or more inner walls of the structural member 10. For example, fasteners, adhesives, or both may be utilized to secure the insert 14 within the structural member 10 (see FIGS. 2 and 5). Alternatively, the insert 14 may be free of fasteners or adhesives to secure the insert 14 within the structural member 10. For example, the insert 14 may create a friction-fit condition between the insert 14 and inner walls of the cavity 12. As such, it is contemplated that the insert 14 may be at least partially compressible to create the friction-fit condition such that the insert 14 may have dimensions that are larger than dimensions of the cavity 12 in an uncompressed state. Additionally, it should be noted that while a substantially rectangular insert 14 within a clamshell structural member 10 is illustrated, any shaped insert 14 and any shaped structural member 10 may be possible.

Figure 2:
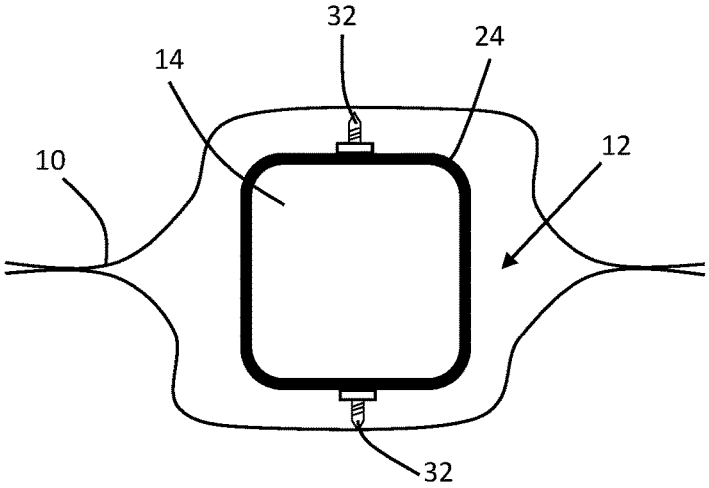
FIG. 2 is a cross-sectional view of an insert positioned within a structural member and secured by fasteners.

FIG. 2 illustrates a cross-sectional view of an insert 14 positioned within a cavity 12 of a structural member 10. The insert 14 may be substantially homogeneous and continuous to maintain a desired performance of reinforcement of the structural member 10. As illustrated, the insert 14 may include a coating 24 disposed along at least a portion of an exterior surface. The coating 24 may further improve performance of the insert 14. For example, the coating 24 may be a ballistic material to prevent penetration of debris and/or fragmentation into or through the insert 14. The coating 24 may be disposed on an entire surface of the insert 14 or only a portion. For example, the coating 24 may cover an entire outer surface of the insert 14 to form a protective layer around the insert 14. It is envisioned that the coating 24 may be any desired thickness. The coating 24 may be substantially uniform or may include localized areas of greater thickness, undulation, contour, or a combination thereof. As shown, the insert 14 may include one or more fasteners 32 to secure the insert 14 within the cavity 12. The fasteners 32 may secure the insert 14 to an inner surface of the cavity 12. The fasteners 32 may extend through panels of the structural member 10. For example, the structural member 10 may include one or more panels formed from sheet metal and the fasteners 32 may be threaded to engage holes within the sheet metal, thereby securing the insert 14 in a desired position.

Figure 3:
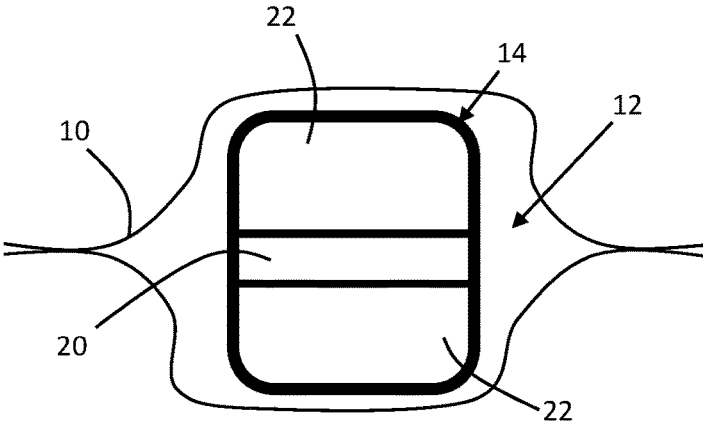
FIG. 3 is a cross-sectional view of a multi-layered insert positioned within a structural member.

FIG. 3 illustrates a cross-sectional view of a multi-layered insert 14 positioned within a cavity 12 of a structural member 10. The insert 14 includes a plurality of layers to improve reinforcing characteristics of the insert 14. As shown, the insert 14 includes a ballistic inner layer 20 sandwiched between opposing reinforcing layers 22. The ballistic layer 20 may be coextensive with one or both reinforcing layers 22. For example, the ballistic layer 20 and the reinforcing layers 22 may all be visible along an outer surface of the insert 14. It should be noted that the ballistic layer 20 and the reinforcing layers 22 may be rearranged in any desired manner. For example, the ballistic layer 20 may be an upper outer surface instead of sandwiched between the reinforcing layers 22. The insert 14 may also include a plurality of ballistic layers 20. For example, the insert 14 may include alternating ballistic layers 20 and reinforcing layers to form the multi-layer structure.

One or more of the layers 20, 22 may be structurally rigid while other layers may be flexible, compressible, or both. For example, the ballistic layer 20 may be structurally rigid to increase bend strength of the insert 14 while the reinforcing layers 22 are each compressible to create a friction-fit assembly with inner walls of the cavity 12. The layers 20, 22 may be secured to one another via adhesives, fasteners, or both. For example, the ballistic layer 20 may be laminated onto one or both reinforcing layers 22 to form the insert. Alternatively, the reinforcing layers 22 may be overmolded onto the ballistic layer 20. As such, it is envisioned that the layers 20, 22 may be free of adhesives or fasteners to secure the layers to one another. For example, the layers 20, 22 may chemically bond to form the insert 14. The bonding may occur due to an activating agent, such as a chemical agent or heightened temperature.

Figure 4:
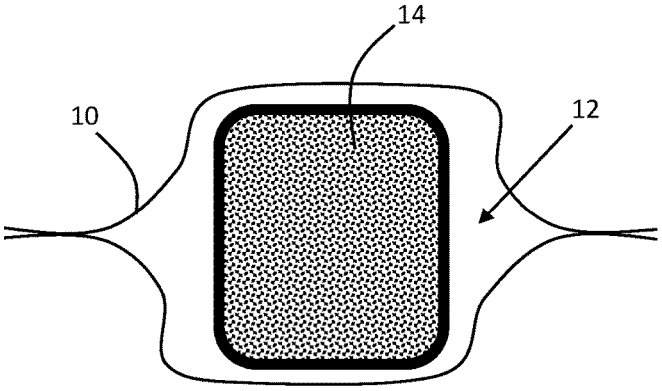
FIG. 4 is a cross-sectional view of an insert positioned within a structural member.

FIG. 4 illustrates a cross-sectional view of an insert 14 positioned within a cavity 12 of a structural member 10. The insert 14 may be tunable based on a desired application. For example, if a vehicle is to be reinforced to prevent penetration of bullets or artillery-shells (i.e., an armored vehicle), the inserts 14 may include a ballistic material to reinforce a structure of the vehicle. The ballistic material may be integrally formed within a composition of the insert 14 material. For example, the ballistic material may be reinforcing fibers mixed within the insert 14 composition so that the reinforcing fibers are found substantially throughout the entire insert 14. As such, it is envisioned that the ballistic material is chemically bonded to the remaining components of the insert 14 such that the ballistic material may not be separated from the insert 14 or visible (e.g., a seam) within the insert 14.

Figure 5:
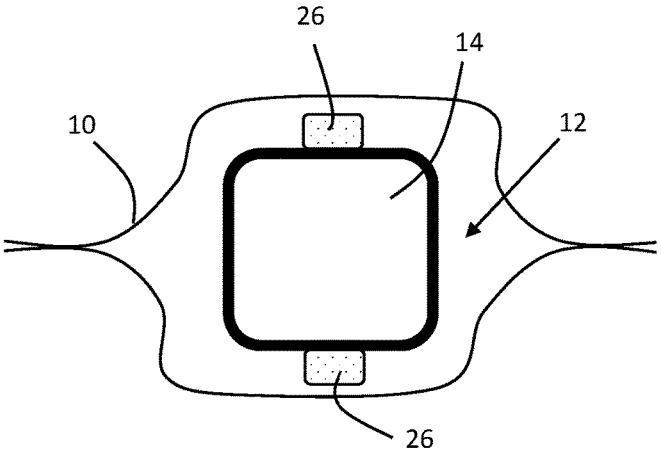
FIG. 5 is a cross-sectional view of an insert secured within a structural member by adhesive.

FIG. 5 illustrates a cross-sectional view of an insert 14 positioned within a cavity 12 of a structural member 10. As shown, the insert 14 may be positioned within the cavity 12 and secured by an adhesive 26 to an inner surface of the cavity 12. The adhesive 26 may be disposed along an outer surface of the insert 14. The adhesive 26 may be positioned anywhere along the insert 14 to mate with the structural member 10. While an adhesive 26 is shown disposed on only two sides of the insert 14, the adhesive 26 may be disposed on all sides of the insert 14. The adhesive 26 may be coextensive with a surface of the insert 14 or may only be partially disposed on a surface of the insert 14. The adhesive 26 may be heat activated or chemically activated to secure the insert within the cavity 12. The adhesive 26 may be used as a temporary or permanent fastening means. For example, the adhesive 26 may temporarily secure the insert 14 until one or more fasteners are driven through the structural member 10 into the insert 14. The adhesive 26 may also be expandable so that it may substantially fill a gap within the cavity 12 between the insert 14 and an inner surface of the structural member 10. As can be gleaned from the teachings herein, the adhesive 26 may be highly tunable based on a given application and may be modified to meet any desired requirements.

Figure 6:
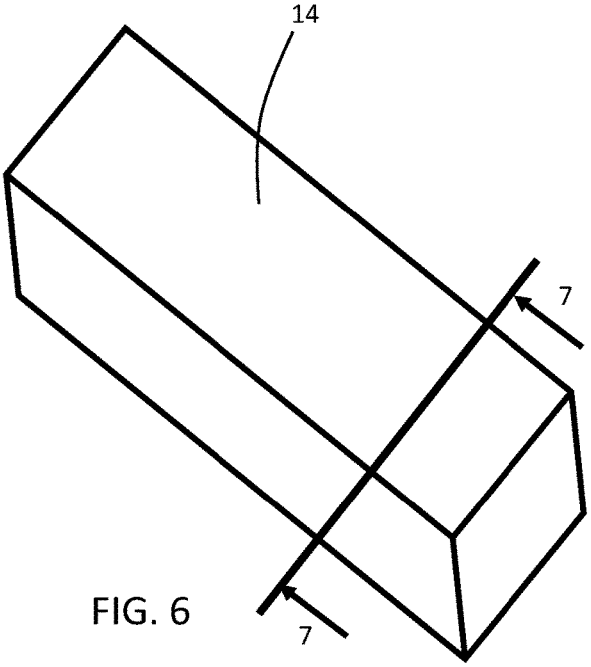
FIG. 6 is a perspective view of an insert.

FIG. 6 illustrates a perspective view of an insert 14 in accordance with the present teachings. The insert 14 may be any desired dimensions to mate with a structural member within a cavity of the structural member (see FIGS. 1-5). While the insert 14 is shown as a box-like structure with substantially orthogonal surfaces, the insert 14 may also include one or more arcuate edges, contoured surfaces, undulations, or a combination thereof. The insert 14 may also include one or more integrally formed fasteners. For example, a plurality of mechanical fasteners (e.g., bolts, nuts, screws, etc.) may be overmolded onto the insert 14 and project from surfaces of the insert 14 to mate with the structural member. The insert 14 may also include one or more substantially smooth surfaces, rough surfaces, or both. For example, an outer surface of the insert 14 may be substantially smooth to decrease friction between the insert 14 and a structural member when inserting the insert 14 into the structural member. Alternatively, or additionally, the outer surface of the insert 14 may be abrasive to increase friction between the insert 14 and the structural member, thereby at least partially preventing movement of the insert 14 relative to the structural member.

Figure 7:
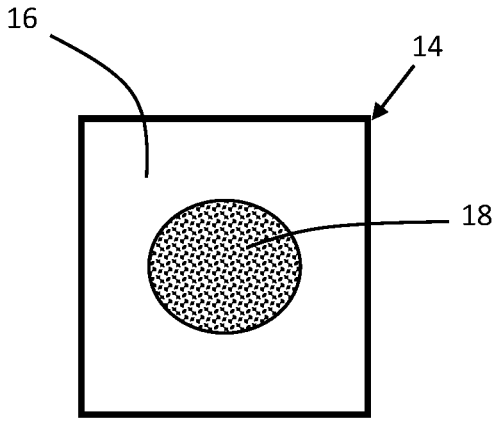
FIG. 7 is cross-section 7-7 of the insert of FIG. 6.

FIG. 7 illustrates cross-section 7-7 of the insert 14 of FIG. 6. The insert 14 includes a core 18 fully encapsulated within a shell 16 of the insert 14. As shown, the core 18 may be formed in a substantially rod-like manner. However, it is envisioned that the core 18 and shell 16 may be any desired shapes and/or dimensions. The core 18 may be formed from a ballistic material to even further reinforce the insert 14. While the core 18 and shell 16 are shown substantially co-axial, it should be noted that the core 18 may be positioned anywhere within the shell 16.

The insert 14 may be manufactured utilizing a variety of processes. For example, the core 18 may be molded in a first mold, transferred to a second mold, and then the shell 16 may be overmolded around the core 18 in the second mold. Alternatively, manufacturing of the insert 14 may be completed in a single mold, such as by utilizing a two-shot injection molding technique—a first injection shot to form the core 18 and a second injection shot to form the shell 16. Additionally, the shell 16 may be initially formed (e.g., by molding, extrusion, etc.) and then the core 18 may be injected within a cavity of the shell 16, thereby creating the resultant insert 14. However, it is also contemplated that the core 18 and shell 16 may be co-extruded and/or co-pultruded to form the insert 14. The insert 14 may also include a final coating process along an outer surface of the insert 14.

Figure 8:
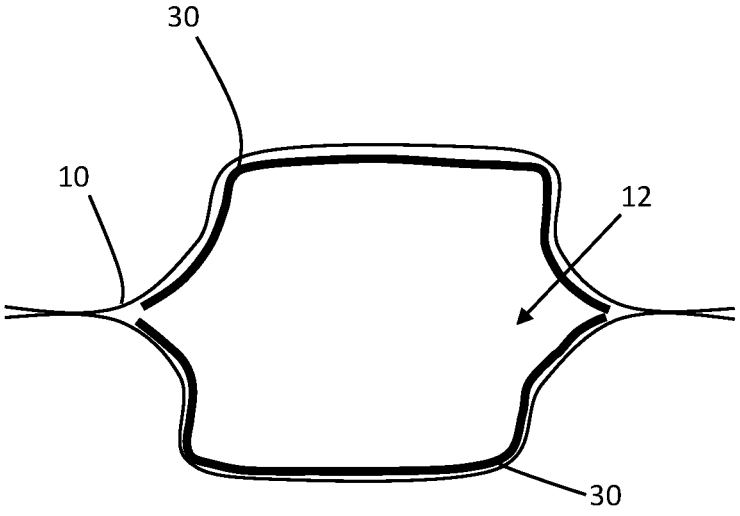
FIG. 8 is a cross-sectional view of a structural member reinforced by ballistic panels.

FIG. 8 illustrates a cross-sectional view of a structural member 10. The structural member 10 includes a cavity 12 formed from a clamshell structure. The cavity 12 includes a pair of reinforcing panels 30 secured to an inner surface of the structural member 10 to reinforce the structural member. The panels 30 may be formed using any techniques describe herein (e.g., pultrusion, molding, extrusion, etc.). However, it is envisioned that the panels 30 may substantially follow a contour of the inner surface of the cavity 12. The panels 30 may be formed of a similar material to that of the inserts described herein. For example, the panels 30 may include or be made from a ballistic material to prevent penetration of the structural member 10 due to a projectile, debris, or both. The panels 30 may include one or more bends, contours, angles, lips, curves, arcuate portions, linear segments, or a combination thereof. The panels 30 may be adhered or fastened within the cavity 12. Alternatively, the panels 30 may be free of fasteners and adhesives yet still be fixed in a desired position within the cavity.

While a pair of separate panels 30 is shown, it is also envisioned that the panels 30 may be joined to one another. For example, the panels 30 may be interconnected to form a substantially hollow insert. Alternatively, the panels 30 may be integrally (i.e., monolithically) formed as a single, unitary insert. The panels 30 may form a clamshell structure that follows a contour of the clamshell structure of the structural member 10. Additionally, while only two panels 30 are shown, it should be noted that any number of panels 30 may be utilized based on a given application.

The explanations and illustrations presented herein are intended to acquaint others skilled in the art with the invention, its principles, and its practical application. The above description is intended to be illustrative and not restrictive. Those skilled in the art may adapt and apply the invention in its numerous forms, as may be best suited to the requirements of a particular use.

Accordingly, the specific embodiments of the present invention as set forth are not intended as being exhaustive or limiting of the teachings. The scope of the teachings should, therefore, be determined not with reference to this description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

Plural elements or steps can be provided by a single integrated element or step. Alternatively, a single element or step might be divided into separate plural elements or steps.

The disclosure of "a" or "one" to describe an element or step is not intended to foreclose additional elements or steps.

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosures of all articles and references, including patent applications and publications, are incorporated by reference for all purposes. Other combinations are also possible as will be gleaned from the following claims, which are also hereby incorporated by reference into this written description.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of within a range of 100+/−15.

ELEMENT LIST

10 Structural Member
12 Cavity
14 Insert
16 Shell
18 Core
20 Ballistic Layer
22 Reinforcing Layer
24 Coating
26 Adhesive
30 Panel
32 Fastener

What is claimed is:

1. An insert for structurally reinforcing a cavity of a structural member, wherein the insert includes: a shell and a core that is fully encapsulated by the shell; and wherein the shell or the core comprises a ballistic material, including para-aramid fibers, aromatic polyamide fibers, or both, to prevent penetration of the structural member by flying debris, fragmentation, or both.

2. The insert of claim 1, wherein the ballistic material of the shell or the core is mixed with thermoplastic elastomeric rubber.

3. The insert of claim 2, wherein the shell has a thickness of about 50 mm to about 20 mm.

4. The insert of claim 3, wherein the insert comprises an expandable adhesive disposed along one or more outer surfaces thereof for securing the insert within the cavity.

5. The insert of claim 4, wherein the shell is made of the ballistic material and the core is made of a thermoplastic elastomeric rubber.

6. The insert of claim 4, wherein the core is made of the ballistic material and the shell is made of a thermoplastic elastomeric rubber.

7. The insert of claim 4, wherein the insert is in a form of a panel that is pre-formed to have a contour that mates to an interior surface of the cavity.

8. The insert of claim 4, wherein the insert includes one or more fasteners to secure the insert within the cavity.

9. The insert of claim 8, wherein the one or more fasteners are overmolded onto the insert.

10. An insert for structurally reinforcing a cavity of a structural member, wherein the insert includes: a multilayered structure with a ballistic layer and reinforcing layers in alternating arrangement; and wherein the ballistic layer includes para-aramid fibers, aromatic polyamide fibers, or both, adapted to prevent penetration of the structural member by flying debris, fragmentation, or both; and wherein the reinforcing layers comprise thermoplastic elastomeric rubber.

11. The insert of claim 10, wherein the para-aramid fibers, aromatic polyamide fibers, or both of the ballistic layer is mixed with thermoplastic elastomeric rubber.

12. The insert of claim 11, wherein the insert comprises an expandable adhesive disposed along one or more outer surfaces thereof for securing the insert within the cavity.

13. The insert of claim 12, wherein the insert includes one or more fasteners to secure the insert within the cavity.

14. The insert of claim 13, wherein the one or more fasteners are overmolded onto the insert.

15. The insert of claim 14, wherein the insert is in a form of a panel that is pre-formed to have a contour that mates to an interior surface of the cavity.

* * * * *